US007000446B2

(12) United States Patent
Nieschulz et al.

(10) Patent No.: US 7,000,446 B2
(45) Date of Patent: Feb. 21, 2006

(54) STAMPING PRESS HAVING FOUR IN ONE GUIDE PIN ASSEMBLY

(75) Inventors: Daniel F. Nieschulz, Macomb, MI (US); Christopher Ballinger, Washington, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 105 days.

(21) Appl. No.: 10/794,962

(22) Filed: Mar. 5, 2004

(65) Prior Publication Data

US 2005/0193795 A1 Sep. 8, 2005

(51) Int. Cl.
*B21D 24/08* (2006.01)

(52) U.S. Cl. ..... 72/350; 72/456

(58) Field of Classification Search ..... 72/350, 72/351, 453.13, 456; 267/119, 130
See application file for complete search history.

(56) References Cited

U.S. PATENT DOCUMENTS 4,483,173 A 11/1984 Duhamel
5,184,496 A 2/1993 Namba et al.
6,647,756 B1 11/2003 Nieschulz
2002/0095969 A1 * 7/2002 Matsunaga ..... 72/350

* cited by examiner

*Primary Examiner*—Derris H. Banks
*Assistant Examiner*—Jimmy T. Nguyen
(74) *Attorney, Agent, or Firm*—Ralph E. Smith

(57) ABSTRACT

Sheet material is stamped between an upper die assembly and a lower die assembly. The lower die assembly includes a lower ring supported on a lower die for vertical movement. The ring cooperates with the upper die assembly in the shaping of the sheet material. Air cushion pins project through holes in the lower die and exert upward pressure on the ring. Guide pins guide the relative vertical movement of the ring. Each guide pin is secured in one of the holes in the lower die. Each guide pin has a tubular lower end portion adapted to receive one of the air cushion pins. A retainer and lockdown block is secured to each guide pin in either a ring retainer position or a ring lockdown position. The block is engageable with a retainer abutment on the ring when the block is in the ring retainer position to prevent the ring from separating from the lower die without interfering with the relative vertical movement of the ring during a stamping generation. The block is engageable with a lockdown abutment on the ring when the block is in the ring lockdown position to lock the ring down on the lower die for machining and spotting.

8 Claims, 5 Drawing Sheets

STAMPING PRESS HAVING FOUR IN ONE GUIDE PIN ASSEMBLY

FIELD OF THE INVENTION

The present invention relates generally to stamping presses, and more particularly to a guide pin assembly for a lower ring of a stamping press.

BACKGROUND OF THE INVENTION

A stamping press has upper and lower die assemblies for shaping sheet metal. Typically, the lower die assembly includes a center post mounted on a lower die. A lower ring surrounds the post and is mounted on the lower die for vertical movement. Air cushion pins projecting through holes in the lower die press the ring upwardly. Guide pins guide the vertical movement of the ring. The post and ring cooperate with an adapter on the upper die assembly to shape sheet metal. Provision should be made for preventing the ring from becoming separated from the lower die, for avoiding interference between the air pins and the guide pins, and for holding the ring when the ring needs machining or spotting. All this should be done a simpler and more economical manner than anything heretofore known in the prior art.

SUMMARY OF THE INVENTION

In accordance with the present invention, the guide pins for guiding the relative vertical movement of the lower ring are secured to the lower die in alignment with selected holes therein. Each guide pin has a tubular lower end portion adapted to receive one of the air cushion pins. A retainer and lockdown block is secured to each guide pin in either a ring retainer position or in a ring lockdown position. The lower ring has a retainer abutment and a lockdown abutment. The block is engageable with the retainer abutment when the block is in the ring retainer position to prevent the ring from falling out or separating from the lower die without interfering with the relative vertical movement of the ring during a stamping operation. The block is engageable with the lockdown abutment when the block is in the ring lockdown position to lock the ring down on the lower die for machining and spotting of the ring.

The guide pins thus, 1) guide the vertical movement of ring, 2) retain the ring from separating or falling out, 3) lock the ring down for machining and spotting, and 4) provide air cushion pin clearance.

Further in accordance with the invention, each block is secured to a top surface of one of the guide pins by a plurality of removable fasteners.

One object of this invention is to provide a press for stamping sheet material in which the lower ring is guided for vertical movement relative to the lower die by one or more guide pins having the foregoing features and capabilities.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application, or uses.

Figure 1:
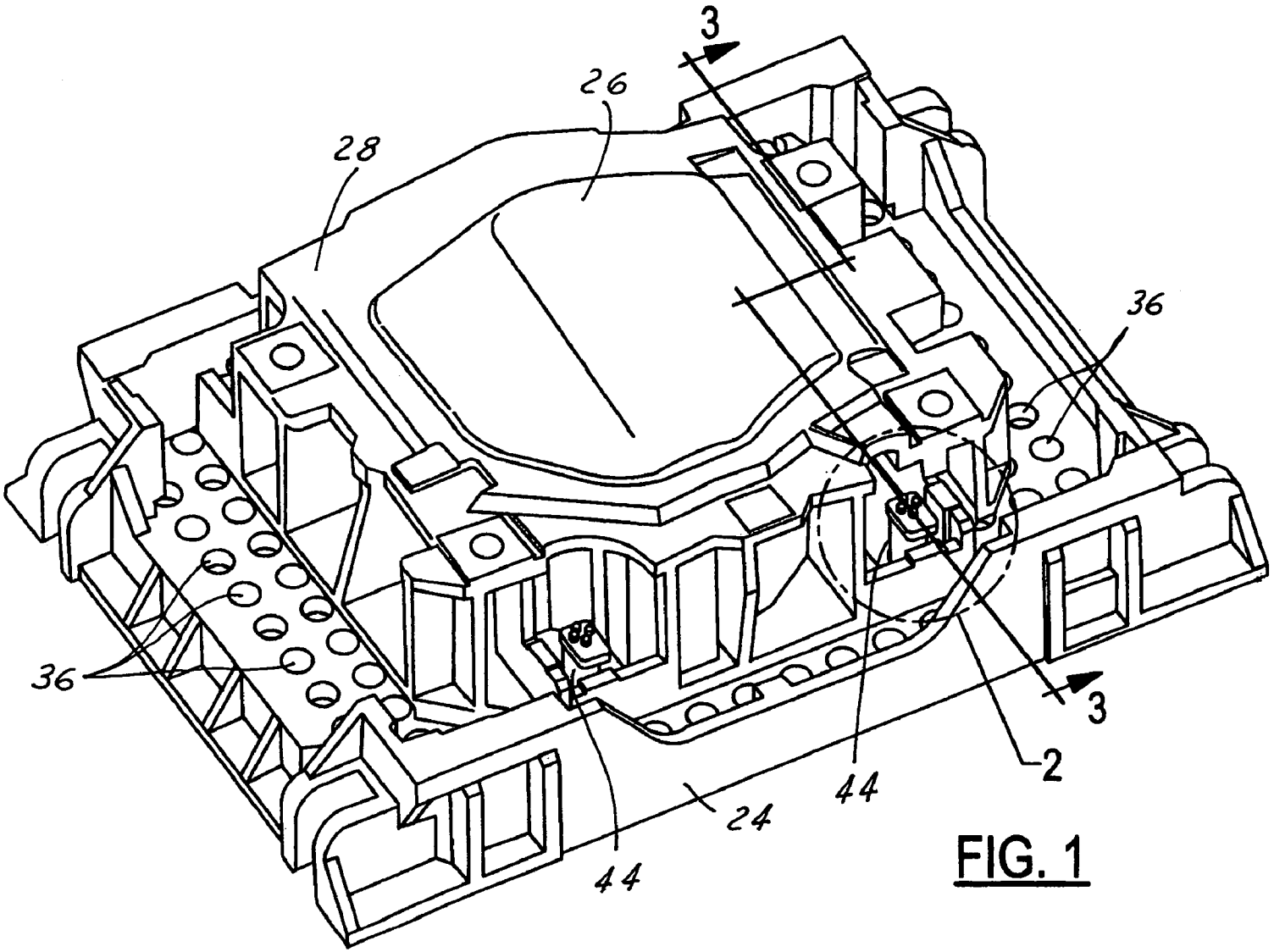
FIG. 1 is a perspective view showing a center post and lower ring supported on a lower die, the ring being guided for vertical movement by guide pins constructed in accordance with this invention.
Figure 2:
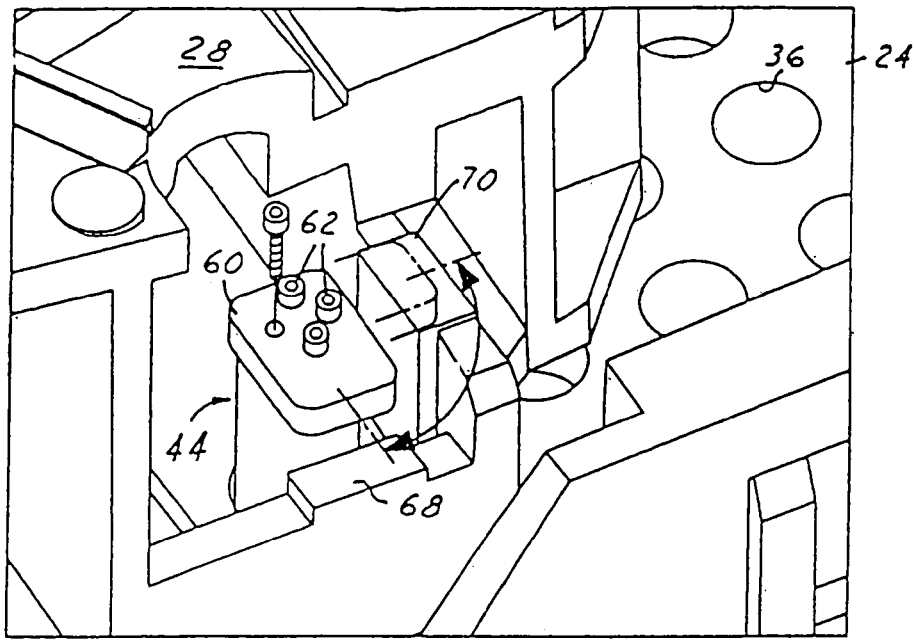
FIG. 2 is an enlarged view of a portion of the structure shown in FIG. 1 within the circle 2.
Figure 4:
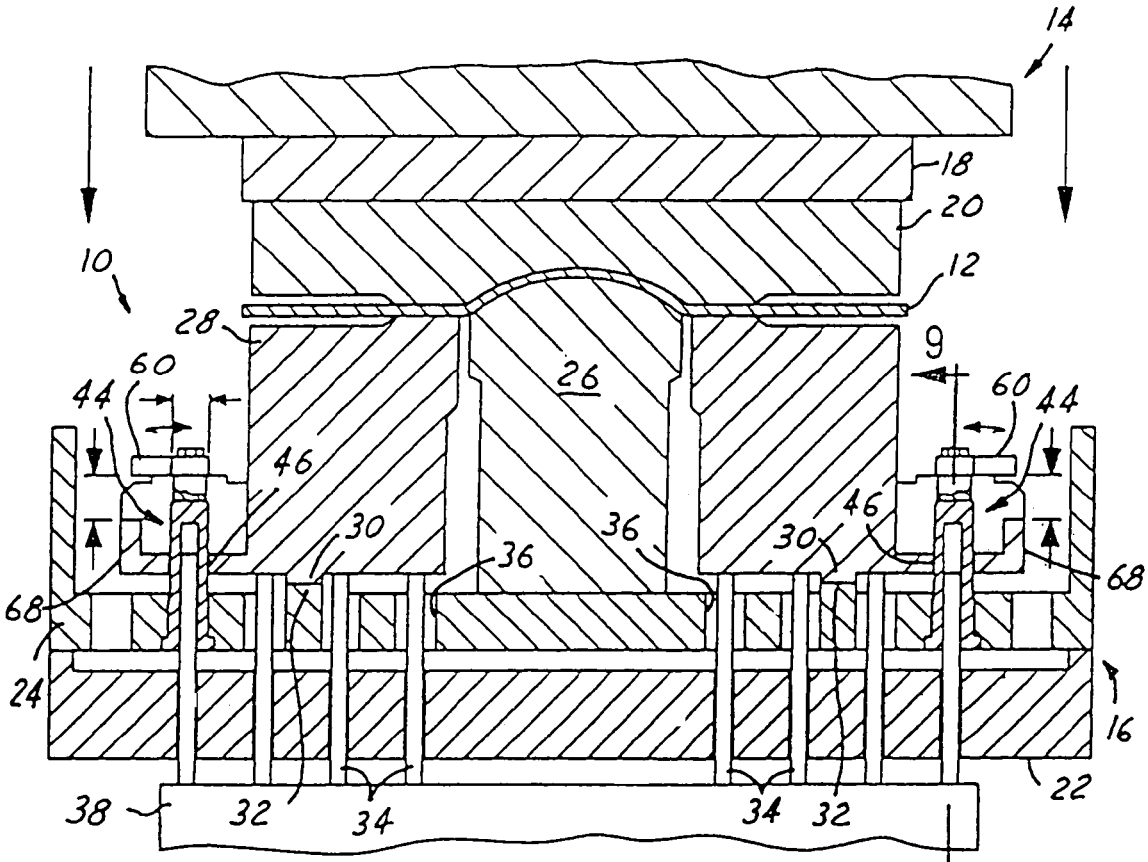
FIG. 4 is a sectional view similar to FIG. 3, but showing the upper die assembly in the lower, or closed position.
Figure 3:
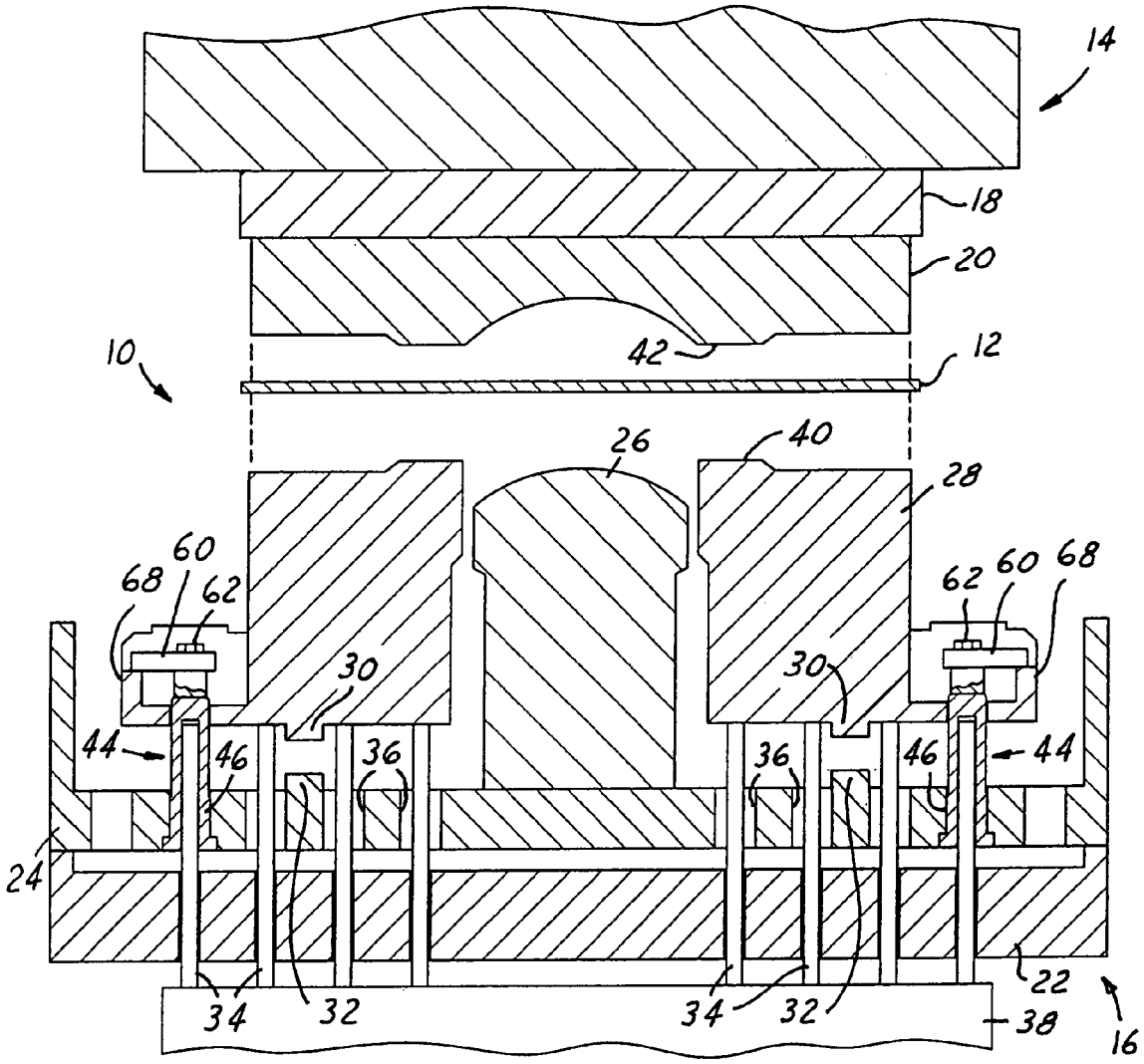
FIG. 3 is a sectional view of a stamping press, taken on the line 3—3 in FIG. 1, in which the upper die assembly is in the up, or open position, and showing two of the guide pins for the lower ring.
Figure 5:
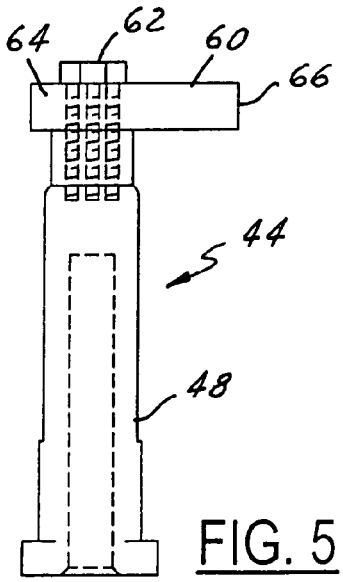
FIG. 5 is an enlarged side view of one of the guide pins.

Referring now more particularly to the drawings, and especially FIGS. 3 and 4, there is shown a press 10 for stamping sheet material 12, such as metal, between an upper die assembly 14 and a lower die assembly 16. The upper die assembly 14 is moved upon and down by a power source, not shown. The upper die assembly 14 includes an upper die 18 and an adapter 20 secured to the bottom of the upper die. The lower die assembly 16 includes a bolster 22 on which a lower die 24 is mounted, a center post 26 projecting upwardly from the lower die 24, and a vertically movable lower ring 28 surrounding the post. The ring 28 has pads 30 on the bottom which come to rest on pads 32 on the lower die when the ring is in the position of FIG. 4 at the end of a stamping cycle.

A plurality of vertical air cushion pins 34 project upwardly from the bolster 22 though closely spaced holes 36 in the lower die. The upper ends of many, if not most, of the air cushion pins 34 contact the bottom of the ring 28. The air cushion pins 34 are vertically slidable in holes in the bolster 22 and in the holes 36 in the lower die and are subjected to upward pressure as by an air pressure source 38 so that the air cushion pins exert upward pressure and support the ring 28. In this embodiment, not all of the air cushion pins 34 contact the ring 28, but the extra pins are nevertheless provided in order to support larger size rings that may be substituted for the ring 28.

The ring 28 has an annular work-engaging clamping surface 40 that opposes a complementary annular clamping surface 42 on the adapter 20. At the beginning of a stamping operation as in FIG. 3, the ring 28 is supported in the elevated position shown by the air cushion pins 34. When the upper die assembly 14 is initially lowered, the clamping surfaces 40 and 42 grip the sheet material 12. Further lowering of the upper die assembly 14 causes the ring 28 to be pressed downwardly to the position of FIG. 4 in which the pads 30 and 32 come into contact, in the process shaping the sheet material 12 to the desired configuration by the upper surfaces of the ring 28 and the post 26 in cooperation with the adapter 20 of the upper die assembly 14.

Figures 7, 8:
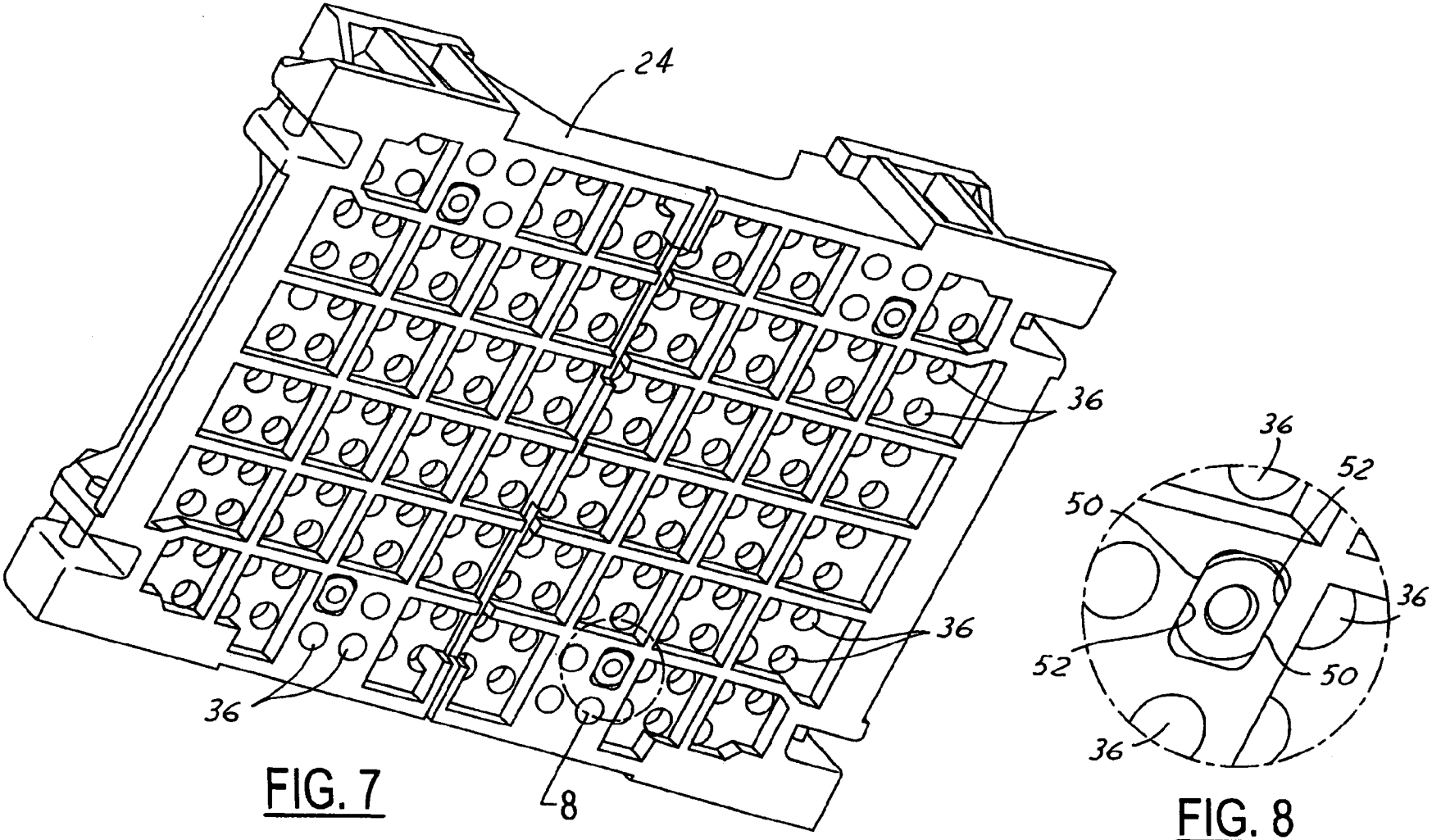
FIG. 7 is a perspective view showing the bottom of the lower die.
FIG. 8 is an enlarged view of the structure in FIG. 7 within the circle 8.

The up and down movement of the ring 28 relative to the lower die 24 is guided by elongated, vertical guide pins 44 which are slidably received in holes 46 in the ring. Because of the close spacing of the holes 36 in the lower die 24, each guide pin 44 is aligned with and extends down into, and is secured in, a selected one of the holes 36 in the lower die. The lower end portion 48 of each guide pin is tubular in order to receive and accommodate that air cushion pin 34 in the hole 36 of the lower die in which the guide pin 44 is secured. The lower end portions 48 of the guide pins 44 have flats 50 which engage flats 52 in the holes 36 to prevent the guide pins from rotating and keep blocks 60 in proper alignment to the lower ring 28 (see FIGS. 7 and 8).

Each of the guide pins 44 has a retainer and lockdown block 60 secured to the top end surface thereof, by an attachment including fasteners in the form of four threaded bolts 62. The four bolts 62 are located at the corners of an imaginary square. The block 60 is preferably in the form of an elongated rectangle with a main body portion 64 resting on the top surface of the guide pin and an extended portion 66 extending outwardly therefrom. The block 60 is shown in FIG. 3 in a ring retainer position extending over an upwardly facing retainer abutment 68 on the ring 28. The retainer abutment 68 is vertically located such that the ring is capable of moving up and down relative to the lower die between the positions shown in FIGS. 3 and 4 during a normal stamping operation.

Figure 9:
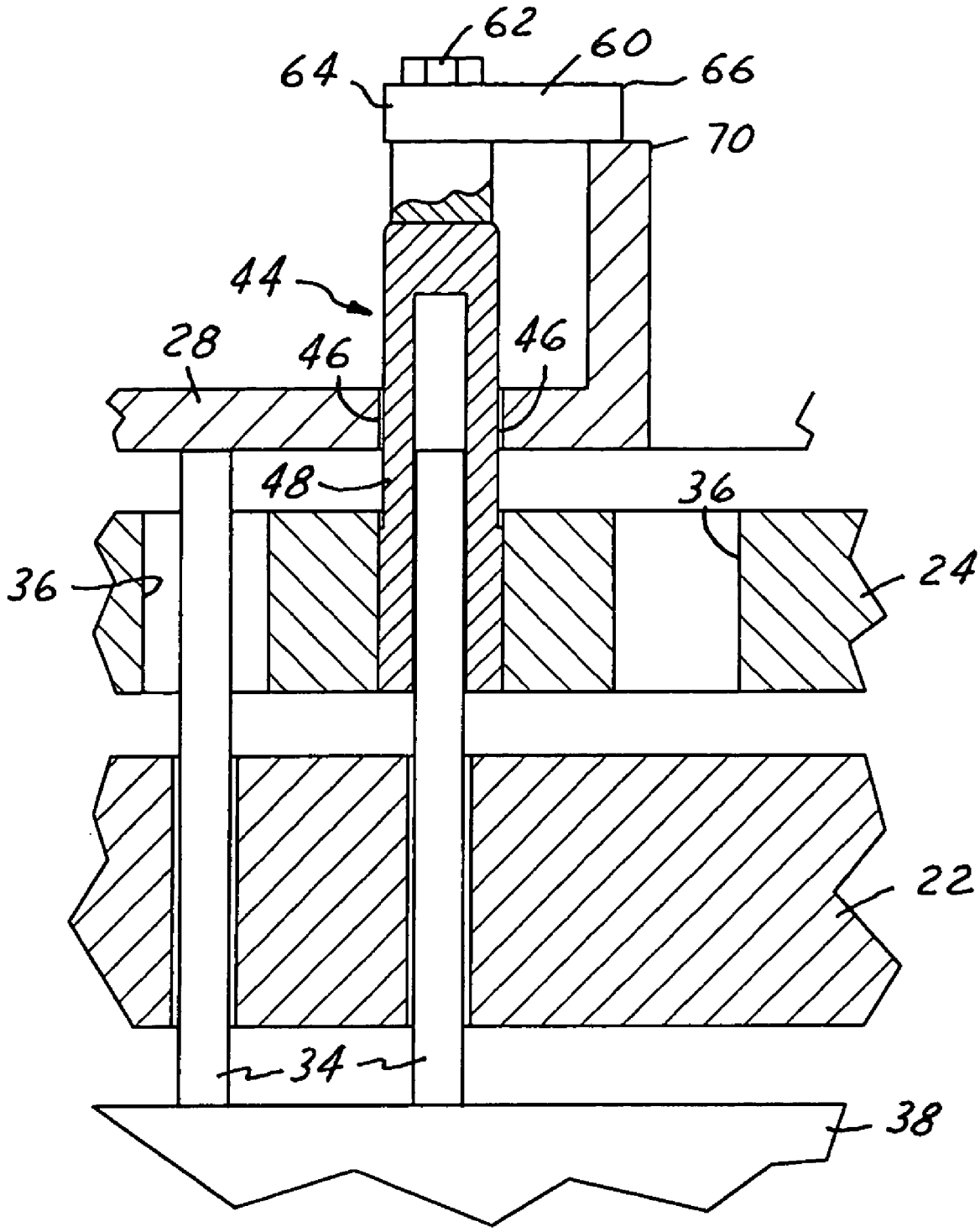
FIG. 9 is a sectional view taken on the line 9—9 in FIG. 4.

The ring also has an upwardly facing lockdown abutment 70 which is vertically located at a level above the retainer abutment 68, although laterally spaced therefrom. The bolts 62 may be removed and then re-installed after the block 60 has been turned to a ring lockdown position extending over the lockdown abutment 70 (see FIG. 9). In the lockdown position of the block 60, the ring 28 is locked down on the lower die 24 with the pads 30 and 32 in contact so that the ring may be machined and/or spotted as necessary.

Figure 6:
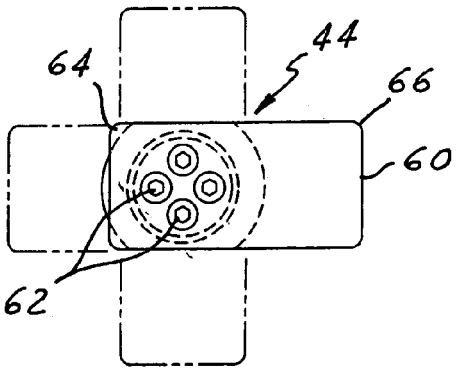
FIG. 6 is a top view of the guide pin in FIG. 5.

As shown in broken lines in FIG. 6, the block 60 may be turned to multiple positions and secured to the guide pin 44 by the bolts 62.

As has been shown, the guide pins 1) guide the vertical movement of the lower ring, 2) retain the ring from falling out or separating from the lower die, 3) lock the ring down for machining and spotting, and 4) provide air cushion pin clearance.

The description of the invention is merely exemplary in nature and, thus, variations that do not depart from the gist of the invention are intended to be within the scope of the invention. Such variations are not to be regarded as departure from the spirit and scope of the invention.

What is claimed is:

1. In a press for stamping sheet material between an upper die assembly and a lower die assembly wherein the lower die assembly includes a lower die, a lower ring supported on the lower die for vertical movement relative to the lower die and cooperable with the upper die assembly in the shaping of the sheet material, and air cushion pins projecting through holes in the lower die and exerting upward pressure on the ring, the improvement comprising:

guide means for guiding the vertical movement of the ring, said guide means including a guide pin, said guide pin being secured to the lower die in alignment with one of the holes therein, said guide pin having a tubular lower end portion adapted to receive one of the air cushion pins projecting upwardly from the lower die, a retainer and lockdown block, an attachment for securing said block to said guide pin selectively in a ring retainer position or in a ring lockdown position, the ring having a retainer abutment and a lockdown abutment, said block being engageable with said retainer abutment when said block is in the ring retainer position to prevent the ring from separating from the lower die without interfering with the relative vertical movement of the ring during a stamping operation, said block being engageable with the lockdown abutment when said block is in the ring lockdown position to lock the ring down on the lower die for machining and spotting of the ring.

2. In the press of claim 1, wherein said guide pin is secured in said one of the holes in the lower die.

3. In the press of claim 2, wherein said block is secured to a top end surface of said guide pin.

4. In the press of claim 3, wherein said attachment includes a plurality of removable fasteners.

5. In the press of claim 3, wherein said attachment includes at least four removable fasteners arranged in a rectangular pattern.

6. In the press of claim 3, wherein the lower end portion of said guide pin is locked against rotation in said one of the holes in the lower die.

7. In the press of claim 3, wherein the lower end portion of said guide pin is locked against rotation in said one of the holes in the lower die by flats on the lower end portion of said guide pin engaging flats in said one of the holes in the lower die.

8. In the press of claim 7, wherein said attachment includes at least four removable bolts arranged in a square pattern.

* * * * *